United States Patent [19]

Kato et al.

[11] 4,234,212

[45] Nov. 18, 1980

[54] RECORDING SHEET

[75] Inventors: Hajime Kato; Yasuhiro Ogata, both of Fujinomiya, Japan

[73] Assignee: Fuji Photo Film Co., Ltd., Minami-ashigara, Japan

[21] Appl. No.: 939,934

[22] Filed: Sep. 6, 1978

[30] Foreign Application Priority Data

Sep. 6, 1977 [JP] Japan ..... 52-106881

[51] Int. Cl.[2] ..... B41M 5/16; B41M 5/18; B41M 5/22

[52] U.S. Cl. ..... 282/27.5; 106/21; 427/150; 427/151; 427/152; 428/307; 428/530; 428/913; 428/914

[58] Field of Search ..... 106/14.5, 21, 24–26; 282/27.5; 427/150, 151, 152; 428/307, 913, 914, 411, 537, 502, 503, 505, 511, 524, 530

[56] References Cited

U.S. PATENT DOCUMENTS

| | | | |
|---|---|---|---|
| 3,896,255 | 7/1975 | Kato et al. | 428/411 |
| 3,924,027 | 12/1975 | Saito et al. | 427/150 X |
| 3,934,070 | 1/1976 | Kimura et al. | 428/411 X |

*Primary Examiner*—Bruce H. Hess

*Attorney, Agent, or Firm*—Sughrue, Rothwell, Mion, Zinn and Macpeak

[57] ABSTRACT

A recording sheet capable of developing color when contacted with substantially colorless electron donating organic compounds functioning as a color former comprising a support having thereon a layer of a dispersion comprising (1) at least one salt of a polyvalent metal and an aromatic carboxylic acid, as a color developer, (2) at least one water-soluble polymer containing hydroxyl groups and (3) at least one of a melamine resin and a urea resin.

11 Claims, No Drawings

RECORDING SHEET

BACKGROUND OF THE INVENTION

1. Field of the Invention

The present invention relates to a recording sheet and, particularly, to an improved color developer composition capable of developing color when contacted with a substantially colorless electron donating organic compound (hereinafter "a color former").

2. Description of the Prior Art

Recording materials utilizing the color forming reaction of color formers with adsorptive or reactive compounds (hereinafter "color developers") which cause a color to develop upon contact with color formers, with specific examples including clay materials, such as acid clay, activated clay, attapulgite, zeolite, bentonite and kaolin; organic acids, such as salicylic acid, tannic acid, gallic acid and phenol compounds; the metal salts of these organic acids; and acidic polymers, such as phenol-formaldehyde condensates, are well known.

The term "color former" as used herein is intended to mean all compounds which become colored through donation of electrons or acceptance of protons, and the term "color developer" as used herein is intended to mean all materials which cause a color to develop through acceptance of electrons or donation of protons.

Specific examples of recording materials utilizing this phenomenon include pressure-sensitive copying papers (e.g., as disclosed in U.S. Pat. Nos. 2,505,470, 2,505,489, 2,550,471, 2,548,366, 2,712,507, 2,730,456, 2,730,457, 3,418,250, and 3,896,255, Japanese Patent Application (OPI) No. 44009/75 (the term "OPI" as used herein refers to a "published unexamined Japanese patent application"), and so on), heat-sensitive recording papers, electro-thermal recording papers (e.g., as disclosed in Japanese Patent Publication No. 4160/68, U.S. Pat. No. 2,939,009, and so on). In addition, a printing process in which a colored image is obtained by supplying a color former-containing ink to a color developer-coated sheet through a medium, such as a stencil, is disclosed in German Patent Application (OLS) No. 1,939,624. In the utilization of the above-described phenomenon, the color former is contacted with the color developer using an external stimulus of some type, for example, the application of a pressure using a pencil, pen or a typewriter or the like, the application of heat and so on.

The most typical example of these recording materials are pressure-sensitive copying papers. The color former layer of a pressure sensitive copying paper is, in general, prepared by dissolving a color former in a suitable solvent, dispersing the resulting solution into a suitable binder or micro-encapsulating the resulting solution with an appropriate colloid and then coating the material obtained on a support, such as paper, a synthetic resin film, a synthetic resin-coated paper or the like. On the other hand, the color developer is dissolved or dispersed in a medium, such as water, together with a suitable binder and then coated on an appropriate support to obtain a color developer sheet.

In general, a color former and a color developer both may be coated on the same surface of a support, they may be coated separately on different sides of the same support, or the color former may be coated on the surface of a support and the color developer is coated on another support. When the color former solution is microencapsulated, the color former solution is released when a localized pressure is applied thereto by writing with a pencil, a ball-point pen or the like, or by typewriting and, consequently, the color former comes into contact with a color developer to result in coloration corresponding to the localized pressure applied. Thus, recording can be achieved.

A wide variety of color developers are known as described above.

However, when clay materials, namely, activated clay, acid clay and the like, which are currently employed in many cases, are used as a color developer, the resulting coloration product has low resistance to light or water. On the other hand, when a phenol monomer or a phenol-formaldehyde resin is employed as a color developer, the color developer-coated sheet has the disadvantage that the color of the coated surface of the color developer-coated sheet tends to yellow.

Polyvalent metal salts of aromatic carboxylic acids were found to be effective color developers (e.g., as disclosed in U.S. Pat. No. 3,934,070) and were color developers which did not have the above-described disadvantages. Namely, the coloration obtained using one of the polyvalent metal salts of aromatic carboxylic acids as a color developer has the advantages that the color has excellent light resistance, the color is not destroyed on contact with water, the color of the color developer layer does not easily change to yellow when exposed to light for a long time, and so on. However, polyvalent metal salts of aromatic carboxylic acids also have a few weak points as color developers which need to be improved. For instance, when the capsule-coated surface and the color developer-coated surface both are immersed in water in face-to-face contact with each other, a color stain of the capsule-coated surface gradually occurs. The color stain is thought to be caused by a transfer of the polyvalent metal salt of an aromatic carboxylic acid from the color developer-coated surface to the capsule-coated surface through the water due to the fact that such a salt is soluble in water to some extent. This defect inherent in polyvalent metal salts of aromatic carboxylic acids impairs to a marked degree the value of recording materials of this kind as an article of commerce, and it is desired to eliminate this defect. In addition, a color developer-coated surface with a sufficiently high strength cannot be attained when a latex binder along is employed therein, because the polyvalent metal salts of aromatic carboxylic acids are soluble in water to some extent. In order to eliminate this disadvantage, for instance, the combined use of a latex binder and water-soluble binder was tried but was unsuccessful because the water resistance of the color developer-coated surface containing such a combination decreased to such an extent that the colored image obtained was easily stripped off when the colored surface was immersed in water and then was rubbed. This characteristic also is a disadvantage which needs to be eliminated.

SUMMARY OF THE INVENTION

Therefore, an object of the present invention is to provide an improved recording sheet on which coloration does not occur when such comes into contact with water.

Another object of the present invention is to provide a recording sheet, the color developer-coated surface of which possesses improved water resistance properties.

The above-described objects are attained by the addition of a melamine resin and/or a urea resin to a dispersion comprising a polyvalent metal salt of an aromatic carboxylic acid and a water-soluble polymer containing hydroxyl groups.

A recording sheet capable of development of color on contact with a substantially colorless electron-donating organic compound and comprising a support having thereon a coated layer of a dispersion of (1) at least one salt of a polyvalent metal and an aromatic carboxylic acid, (2) at least one water-soluble high polymer containing hydroxy groups, and (3) at least one of a melamine resin and a urea resin.

DETAILED DESCRIPTION OF THE INVENTION

Suitable polyvalent metal salts of aromatic carboxylic acids which can be employed in the present invention include those polyvalent metal salts of aromatic carboxylic acids represented by the following general formula (I):

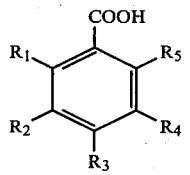

(I)

wherein $R_1$, $R_2$, $R_3$, $R_4$ and $R_5$, which may be the same or different, each may have up to 18 carbon atoms and represents, for example, a hydrogen atom, a halogen atom (e.g., a chlorine atom or a bromine atom), a hydroxy group, an amino group, an alkylamino group (e.g., an alkylamino group substituted with one or two alkyl groups containing 1 to 12 carbon atoms, such as a methylamino group, an ethylamino group, an isobutylamino group, an octylamino group, a dodecylamino group, a diethylamino group, a dibutylamino group, a di-2-ethylhexylamino group, an N-ethyl-N-octylamino group, etc.), a nitro group, an aldehyde group, an alkyl group (e.g., an alkyl group containing 1 to 12 carbon atoms, such as a methyl group, an ethyl group, a butyl group, an octyl group, a t-butyl group, a dodecyl group, etc.), a cycloalkyl group (e.g., a cycloalkyl group containing 5 to 7 carbon atoms, e.g., a cyclohexyl group, a methylcyclohexyl group, etc.), an aryl group (e.g., an aryl group containing 6 to 10 carbon atoms, such as a phenyl group, a naphthyl group, etc.), an alkylaryl group (e.g., a phenyl group or a naphthyl group substituted with one or more alkyl groups containing 1 to 12 carbon atoms, such as a methylphenyl group, an ethylphenyl group, a 2,4-di-t-amylphenyl group, an octylphenyl group, a dodecylphenyl group, a methylnaphthyl group, etc.), an aralkyl group (e.g., an aralkyl group containing 7 to 20 carbon atoms, such as a benzyl group, a phenethyl group, a methylbenzyl group, etc.), an alkoxy group (e.g., an alkoxy group containing 1 to 12 carbon atoms, such as an ethoxy group, a methoxy group, a butoxy group, etc.), and so on. Also, $R_1$ and $R_2$, $R_3$ and $R_4$ and/or $R_4$ and $R_5$ may combine and form a 5- or a 6-membered ring (e.g., a 5- or 6-membered carbon-containing ring).

Of the compounds represented by the above-described general formula (I), those compounds in which at least either $R_1$ or $R_5$ is a hydroxy group and which are substituted with an alkyl group, an aryl group, an aralkyl group or other groups in positions ortho and para to such a hydroxy group, are especially useful in the present invention.

Specific examples of aromatic carboxylic acids represented by the general formula (I) include 2,4-dichlorobenzoic acid, p-isopropylbenzoic acid, 2,5-dinitrobenzoic acid, p-t-butylbenzoic acid, N-phenylanthranilic acid, 4-methyl-3-nitrobenzoic acid, salicylic acid, m-hydroxybenzoic acid, p-hydroxybenzoic acid, 3,5-dinitrosalicylic acid, 5-t-butyl-salicylic acid, 3-phenylsalicylic acid, 3-methyl-5-t-butylsalicylic acid, 3,5-di-t-amylsalicylic acid, 3-cyclohexylsalicylic acid, 5-cyclohexylsalicylic acid, 3-methyl-5-isoamylsalicylic acid, 5-isoamylsalicylic acid, 3,5-di-sec-butylsalicylic acid, 5-nonylsalicylic acid, 2-hydroxy-3-methylbenzoic acid, 2-hydroxy-5-t-butylbenzoic acid, 2,4-cresotinic acid, 5,5-methylenedisalicylic acid, acetoamino-benzoic acids (o-, m- and p-), 2,4-dihydroxybenzoic acid, 2,5-dihydroxybenzoic acid, anacardic acid, 1-naphthoic acid, 2-naphthoic acid, 1-hydroxy-2-naphthoic acid, 2-hydroxy-3-naphthoic acid, 2-hydroxy-1-naphthoic acid, thiosalicylic acid and the like. Preferred examples of aromatic carboxylic acids represented by the general formula (I) include 3,5-di(α-methyl-benzyl)salicylic acid, 3-(α-methylbenzyl)-5-(α,α-dimethyl-benzyl)salicylic acid, 3-(4'-α',α'-dimethylbenzyl)phenyl-5-(α,α-dimethylbenzyl)salicylic acid, 3,5-di-t-butylsalicylic acid, 3,5-di-t-octylsalicylic acid, 3-cyclohexyl-5-(α,α-dimethylbenzyl)salicylic acid, 3-phenyl-5-(α,α-dimethylbenzyl)-salicylic acid, 3,5-di(α,α-dimethylbenzyl)-salicylic acid and so on.

Suitable polyvalent metals forming salts with the above-described aromatic carboxylic acids are, for example, magnesium, aluminum, calcium, scandium, titanium, vanadium, chromium, manganese, iron, cobalt, nickel, copper, zinc, gallium, germanium, strontium, yttrium, zirconium, molybdenum, silver, cadmium, indium, tin, antimony, barium, tungsten, lead, bismuth and so on. Of these metals, especially effective polyvalent metals include zinc, tin, aluminum, magnesium, calcium and the like. The most preferred polyvalent metal is zinc.

In general, a specific binder is employed in preparing a coating solution containing a color developer. The binder is selected depending upon the strength of the film which the binder forms, the dispersibility of a color developer to be employed into the binder and the extent of influence of the binder upon the color development capability of a color developer to be used.

Examples of suitable water-soluble polymers as binders which can be used include water-soluble binders where crystals and cross-linking are not present and containing hydroxyl groups, carboxyl groups, sulfo groups, or salts thereof, for example, natural macromolecular compounds, such as proteins (e.g., gelatin, albumin, casein, etc.), starches (e.g., cereal starch, α-starch, oxidized starch, etherified starch, esterified starch, etc.), celluloses (e.g., carboxymethyl cellulose, hydroxymethyl cellulose, etc.), saccharides (e.g., agar, sodium alginate, carboxymethyl starch, gum arabic, etc.) and the like; and water-soluble synthetic high polymers, such as polyvinyl alcohol (PVA), polyvinyl pyrrolidone, polyacrylic acid, polyacrylamide, maleic acid copolymers and the like.

Moreover, examples of suitable latex binders include styrene-butadiene latex (SBR), acrylonitrile-butadiene latex, acrylic acid type latexes, vinyl acetate type latexes, methylmethacrylate-butadiene latex, and the carboxy denatured latexes thereof.

The latex binders tend to be influenced by metal ions and, therefore, it is difficult to attain sufficient coating strength when a latex binder is used as the binder for aromatic carboxylic acid-metal salts. However, latex binders have the advantages of low viscosity, excellent water resistance and so on. On the other hand, water-soluble binders and, particularly, those which have hydroxy groups, are affected by metal ions only slightly and, therefore, water-soluble binders are desirable for use as the binder for the polyvalent metal salts of aromatic carboxylic acids.

Of these binders, especially desirable binders are polyvinyl alcohol (PVA) and starch. PVA is the most preferred binder because of its strong binding power.

PVA which can be effectively employed in the present invention has a degree of saponification of about 80 to about 100% and, particularly, 90 to 100%; and a degree of polymerization of about 200 to about 3,000 and, particularly, 500 to 2,000. A preferred degree of polymerization for starch (i.e., repeating number of glucose units in the molecule) is about 300 to about 10,000.

When such a water-soluble binder as described above is employed alone, the viscosity of the resulting coating solution increases and the coating obtained has inferior water resistance to that obtained with a latex binder, although a sufficiently high coating strength can be achieved by the sole use of a water-soluble binder. Accordingly, the combined use of a water-soluble binder and a latex binder is desirable. Styrenebutadiene (SBR) latex, acrylic acid ester type latex and the carboxy denatured latexes thereof are preferred to the other latex binders described above. In particular, a carboxy denatured SBR latex is preferred.

A preferred ratio by weight (on a solid basis) of the latex to the water-soluble binder ranges from about 10:100 to about 1,000:100 and, particularly, from 50:100 to 500:100.

In addition, a preferred total amount of the binder is about 50 parts by weight or less and, particularly, 20 parts by weight or less, per 100 parts by weight of the solids present in a coating solution.

The amount of the binder employed is determined by balancing the color development capability and the strength of the coated layer. The smaller the amount of the binder employed becomes, the lower the cost of preparation becomes. Therefore, the smallest amount of a binder which can be used is desirable.

Moreover, a water-soluble melamine resin or/and a water-soluble urea resin is/are employed in the present invention. The use of these resins minimizes the degree of coloration on contact with water and improves the water resistance property of the coated layer.

Widely known and used additives, such as glyoxal, zirconium salts, chromium salts and so on do not entirely exhibit the effects required in the present invention. Suitable water-soluble melamine resins and/or water-soluble urea resins which can be employed in the present invention include those in which the number of triazine rings, urea units or urea derivative units in the molecule is preferably 1 to 10 and, more specifically, include melamine resins, such as methylol melamine resins, methylated methylol melamine resins and the like, and urea resins, such as methylol urea resins, methylated methylol urea resins and the like. Suitable melamine resins which can be used are described in U.S. Pat. No. b 2,197,357 and suitable urea resins which can be used are described in *J. Am. Chem. Soc.*, 68, 1981 (1946).

Of these resins, a melamine resin exerts especially large effects upon both the color developer and the polymer binder used in the present invention. Although the mechanism responsible for the above-described effects is not at present clear, it is possible these resins react with the hydroxy groups of the water-soluble binder present such that the polyvalent metal salt of an aromatic carboxylic acid results in the blocking of the hydroxy groups and, further, form crosslinks among the water-soluble binder molecules during both the coating and drying processes.

A preferred amount of the urea or melamine resin ranges from about 1 part by weight to 100 parts by weight (on a resin basis) and, desirably, from 5 parts by weight to 30 parts by weight, per 100 parts by weight of the water-soluble binder. It is particularly desirable in order to achieve the effects of the present invention for the pH of the thus-obtained coating solution to be adjusted to a pH of about 9 or lower, particularly, 8.5 or lower.

The recording sheet of the present invention can be obtained by coating, on a support, such as paper, synthetic paper, a sythetic resin film, etc., a coating solution prepared by dispersing or dissolving the above-described binders and color developer into water, and then drying the coated layer.

Metallic compounds, such as the oxides, the hydroxides, the silicates or the carbonates of particular metals selected from the group consisting of zinc, aluminum, calcium, magnesium, titanium, nickel, cobalt, manganese, iron, tin, copper, vanadium and chromium; inorganic pigments, such as talc, kaolin, pyrophyllite, etc.; synthetic resin powders; dispersants; defoaming agents; antioxidants and so on may be added to the coating solution used in the present invention to improve the color development capability and the surface properties of the coated layer, e.g., as disclosed in, for example, U.S. Pat. Nos. 2,711,375, 3,625,736, 3,836,383, and 3,846,331, British Pat. No. 1,232,347, and so on.

Moreover, other color developers, which possess the properties defined hereinbefore, with specific examples including clay materials, phenols, phenol resins, aromatic carboxylic acids and so on may be also employed in combinations with the color developers of the present invention.

Suitable coating techniques which can be used are those commonly employed by one skilled in this art. For instance, the coating can be carried out using an air-knife coater, a roll coater, a blade coater, a size press coater, a curtain coater and so on. A single layer can be coated or a plurality of layers can be coated simultaneously, as desired.

The coated amount will vary depending upon the kind of color developer used in the combintion. In general, the color developer is preferably coated at a coverage of about 0.03 $g/m^2$ to about 6 $g/m^2$. A coating coverage less than about 0.03 $g/m^2$ does not provide sufficient color development capability, and a coating coverage of up to about 6 $g/m^2$ is selected not so much upon color development capability as economic reasons.

Color formers capable of reacting with the color developers employed in the recording sheets of the present invention are not particularly limited. Specific examples of suitable color formers which can be used include (1) triarylmethane compounds, such as 3,3-bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide and so on; (2) diphenylmethane compounds, such as 4,4'-bis-dimethylaminobenzohydrin benzyl ether, N-halophenyl leuco auramine, N-2,4,5-trichlorophenyl leuco auramine and so on; (3) xanthene compounds, such as Rhodamine B anilinolactam, Rhodamine B p-nitroanilinolactam, Rhodamine B p-chloroanilinolactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,2-dimethylfluoran, 7-diethylamino-3-acetylmethylaminofluoran, 7-diethylamino-3'-methylaminofluoran, 3,7-diethylaminofluoran, 7-diethylamino-3-dibenzylaminofluoran, 7-diethylamino-3-methylbenzylaminofluoran, 7-diethylamino-3-chloroethylmethylaminofluoran, 7-diethylamino-3-diethylaminofluoran and so on; (4) thiazine compounds, such as benzoyl leuco Methylene Blue, p-nitrobenzoyl leuco Methylene Blue and so on; (5) spiro-compounds, such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxybenzo)-spiropyran, 3-propyl-spiro-dibenzopyran and so on; and mixtures thereof. The color former which is employed is selected depending upon the purposes of end-use and the characteristics desired. Of these color formers, triarylmethane compounds, particularly, crystal violet lactone, enhance the effects of the present invention.

The color former can be coated on a support in a form of microcapsules prepared by encapsulating a solution of the color former in a suitable solvent or as a dispersion prepared by dispersing the color former into a suitable binder. A suitable coating amount of the color former is about 0.01 to 5 g/m$^2$, preferably 0.05 to 0.5 g/m$^2$, of the support.

Suitable solvents which can be used for the color former include natural or synthetic oils, individually or as a combination thereof. Specific examples of suitable solvents include cotton seed oil, kerosene, paraffins, naphthene oils, alkylated biphenyls, alkylated terphenyls, alkylated naphthalenes, diarylethanes, triarylmethanes, chlorinated paraffins and so on. Specific examples of processes for preparing microcapsules containing the color former solution include a coacervation process in which a solution of a color former dissolved in one of the above-described solvents is microencapsulated using a hydrophilic colloid, as disclosed in U.S. Pat. Nos. 2,800,457 and 2,800,458; an interfacial polymerization process as disclosed in British Pats. No. 867,797, 950,443, 989,264, 1,091,076, and so on; and so on.

The present invention provides an improved recording sheet in which (1) the coloration phenomenon resulting from contact with water is minimized and (2) the water resistance property of the coated layer is improved.

Preparation of microcapsules containing color formers according to the process described in, for example, U.S. Pat. No. 2,800,457 is specifically illustrated below. Unless otherwise indicated, all parts, percents, ratios and the like are by weight.

10 parts of acid processed pigskin gelatin and 10 parts of gum arabic were dissolved in 400 parts of water at 40° C. To the resulting solution, 0.2 part of Turkey red oil was added as an emulsifier and then 40 parts of a color former oil, which was prepared by dissolving crystal violet lactone into diisopropylnapthalene in a concentration of 2%, was dispersed thereinto to emulsify.

When the size of the oil droplets became 5 microns on the average, the emulsification was discontinued. Then, water at 40° C. was added thereto to make the total amount of the emulsion 900 parts, and the stirring was continued. Thereafter, a 10 wt% acetic acid aqueous solution was added thereto, while continuing the stirring, to adjust the pH to 4.0 to 4.2 to result in the production of coacervates. After continuing the stirring for 20 minutes, the system was cooled using an ice water bath to cause gelling of the coacervate membrane deposited around the oil droplets.

The stirring was continued and when the liquid temperature reached 20° C., 7 parts of a 37 wt% aqueous solution of formaldehyde was added. Stirring and cooling were continued, and when the liquid temperature reached 10° C., a 15 wt% aqeuous solution of sodium hydroxide was added to adjust the pH to 9. While stirring was continued, the liquid temperature was raised to 50° C. over a 20 minute period.

The thus-obtained microcapsule dispersion was cooled to 30° C. and then the dispersion was coated on paper having a basis weight of 40 g/m$^2$ at a dry coverage of 6 g/m$^2$ (on a solid basis) and the coated layer was dried.

Thus, a sheet coated with microcapsules containing crystal violet lactone as a color former was obtained.

The following examples are given to illustrate the present invention in greater detail. All parts, percents, etc. are by weight.

EXAMPLE 1

2 parts of zinc oxide, 18 parts of pyrophillite and 4 parts of zinc 3,5-di-tert-butylsalicylate were mixed with 70 parts of water and then the mixture was dispersed in the water for 30 minutes using an attriter. To the resulting dispersion, 2.5 parts (on a solid basis) of a carboxy denatured SBR latex, 12 parts of a 10 wt% aqueous solution of PVA (having a degree of saponification of 99% and a degree of polymerization of 1,000) and 2.4 parts of a 10 wt% aqueous solution of methylated trimethylol melamine were added and stirred to obtain a homogeneous coating solution. The thus-obtained coating solution was applied to a paper having a basis weight of 50 g/m$^2$ at a coverage of 4 g/m$^2$ (on a solid basis) using an air-knife coater and dried to obtain a recording sheet of the present invention.

COMPARISON EXAMPLE 1

A recording sheet for comparison was prepared in the same manner as described in Example 1 except that the methylated trimethylolmelamine was not added to the coating solution.

EXAMPLE 2

Another recording sheet of the present invention was prepared in the same manner as described in Example 1 except that 10 parts of aluminum hydroxide and 8 parts of activated clay were employed instead of the 18 parts of pyrophillite.

COMPARISON EXAMPLE 2

Another recording sheet for comparison was prepared in the same manner as in Example 2 except that the methylated trimethylolmelamine was not employed.

EXAMPLE 3

A further recording sheet of the present invention was prepared in the same manner as described in Example 1 except that zinc 3,5-di(α-methylbenzyl)salicylate was employed instead of zinc 3,5-di-tert-butylsalicylate.

COMPARISON EXAMPLE 3

A further recording sheet for comparison was prepared in the same manner as in Example 3 except that the methylated trimethylolmelamine was not employed.

The recording sheets produced in the Examples and Comparison Examples were evaluated in the following manner.

(i) Coloration on Contact with Water:

Each of the recording sheets of the present invention and each of the recording sheets prepared for comparison, and a microcapsule sheet containing crystal violet lactone were immersed in water and then they were superposed upon each other so that the color developer-coated surface came into contact with the microcapsule-coated surface and the assembly was air-dried. After the drying was completed, the density of coloration at the microcapsule-coated surface was measured using a reflection spectrophotometer, and the density measured was taken as a measure of the degree of coloration resulting from contact with water. The results obtained are shown in the table below.

(ii) Water Resistance of Coated Layer:

Each of the recording sheets of the present invention and each of the recording sheets prepared for comparison, and a microcapsule sheet were placed into face-to-face contact with each other. To such superposed sheets, a load of 150 kg/cm$^2$ was applied to cause coloration. The resulting sheets were allowed to stand for one day in a dark room. The density of the coloration was measured using a reflection spectrophotometer and the density measured was taken as the fresh density. Next, this colored recording sheet was immersed in water for 30 seconds and then the sheet was rubbed with a rubber ball to which a load of 20 kg/cm$^2$ was continuously applied for 1 minute. After air-drying the sheet, the density of coloration was again measured, and the resulting density was taken as the density after water contact and rubbing. The results obtained are shown in the table below.

| Sample | Coloration on Contact with Water Density at 610 nm | Water Resistance Property of Coated Layer: Fresh Density at 610 nm | Water Resistance Property of Coated Layer: Denisty after Water Contact/Rubbing at 610 nm |
|---|---|---|---|
| Example 1 | 0.15 | 0.88 | 0.81 |
| Comparison Example 1 | 0.76 | 0.88 | 0.42 |
| Example 2 | 0.13 | 0.89 | 0.82 |
| Comparison Example 2 | 0.78 | 0.89 | 0.41 |
| Example 3 | 0.09 | 0.89 | 0.85 |
| Comparision Example 3 | 0.41 | 0.89 | 0.46 |

In the above table, a low density is desirable for Coloration on Contact with Water and a high density is desirable for Water Resistance Property.

It can be seen from the results in the table above that the coloration phenomenon resulting from contact with water and the water resistance property of the coated layer both were markedly improved in the present invention.

While the invention has been described in detail and with reference to specific embodiments thereof, it will be apparent to one skilled in the art that various changes and modifications can be made therein without departing from the spirit and scope thereof.

What is claimed is:

1. A recording sheet capable of development of color on contact with a substantially colorless electron donating organic compound comprising a support having thereon a coated layer of a dispersion of (1) at least one salt of a polyvalent metal and an aromatic carboxylic acid, (2) at least one water-soluble polymer containing hydroxy groups and (3) a methylated methylalmelamine resin.

2. The recording sheet of claim 1, wherein said polyvalent metal is magnesium, aluminum, calcium, scandium, titanium, vanadium, chromium, manganese, iron, cobalt, nickel, copper, zinc, gallium, germanium, strontium, yttrium, zirconium, molybdenum, silver, cadmium, indium, tin, antimony, barium, tungsten, lead, or bismuth.

3. The recording sheet of claim 1, wherein said aromatic carboxylic acid is an aromatic carboxylic acid represented by the general formula (I):

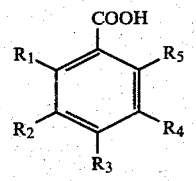

(I)

wherein $R_1$, $R_2$, $R_3$, $R_4$ and $R_5$, which may be the same or different, each may have up to 18 carbon atoms and represents a hydrogen atom, a halogen atom, a hydroxy group, an amino group, an alkylamino group, a nitro group, an aldehyde group, an alkyl group, a cycloalkyl group, an aryl group, an alkyl-aryl group, an arylalkyl group, or an alkoxy group and $R_1$ and $R_2$, $R_3$ and $R_4$ and/or $R_4$ and $R_5$ may combine and form a 5- or 6-membered ring.

4. The recording sheet of claim 1, wherein at least either $R_1$ or $R_5$ is a hydroxy group and the positions ortho and para to said hydroxy group are substituted with an alkyl group, an aryl group or an arylalkyl group.

5. The recording sheet of claim 1, wherein said water-soluble polymer is a protein, a starch, a cellulose, polyvinyl alcohol, polyvinyl pyrrolidone, polyacrylic acid, polyacrylimide or a maleic acid copolymer.

6. The recording sheet of claim 1, wherein said water-soluble polymer is polyvinyl alcohol having a degree of saponification of about 80 to about 100% and a degree of polymerization of about 200 to about 3,000.

7. The recording sheet of claim 1, wherein said water-soluble polymer is a starch containing a degree of polymerization of about 300 to about 10,000.

8. The recording sheet of claim 1, wherein said polyvalent metal is zinc.

9. The recording sheet of claim 8 wherein said aromatic carboxylic acid is 3,5-di-t-butylsalicylic acid.

10. The recording sheet of claim 1, wherein the amount of said methylated methylolmelamine resin is from about 1 part by weight to 100 parts by weight (on a resin basis) per 100 parts by weight of the water-soluble polymer.

11. The recording sheet of claim 1, wherein said recording sheet additionally includes, on the opposite surface of the support having said coated layer thereon, a coated layer of a substantially colorless electron-donating organic compound as a color former.

* * * * *